33-241

11/4/85 XR 4,620,372 SR

United States Patent [19]

Goodrich

[11] Patent Number: 4,620,372

[45] Date of Patent: Nov. 4, 1986

[54] SIGHT SYSTEM FOR ARCHERY

[76] Inventor: George W. Goodrich, 5123 N. Kellen Ct., Bloomfield Hills, Mich. 48013

[21] Appl. No.: 706,088

[22] Filed: Feb. 27, 1985

[51] Int. Cl.[4] ..... F41G 1/46; F41G 1/32

[52] U.S. Cl. ..... 33/265; 33/241

[58] Field of Search ..... 33/241, 265, DIG. 8; 124/87

[56] References Cited

U.S. PATENT DOCUMENTS

| | | | |
|---|---|---|---|
| 3,266,149 | 8/1966 | Powell | 33/265 |
| 3,302,292 | 2/1967 | Akin, Jr. | 33/265 |
| 3,700,339 | 10/1972 | Steck, III | 33/241 |
| 3,949,482 | 4/1976 | Ross | 33/241 |
| 4,291,469 | 9/1981 | Weast | 33/265 |
| 4,462,163 | 7/1984 | Tentler et al. | 33/265 |

FOREIGN PATENT DOCUMENTS

| | | | |
|---|---|---|---|
| 1532090 | 11/1978 | United Kingdom | 33/241 |

*Primary Examiner*—Richard R. Stearns

[57] ABSTRACT

A multi-range, accuracy enhancing sight system for the archery bow comprising a vertical array of micro-telescopic or restricted-field direct-view collimator sights mounted so that both the field of each sight and the position of the parallax-free fiducial reference of each sight within the field are independently adjustable in the horizontal and vertical directions. In a preferred embodiment each sight is affixed to an elongated bridge member adjustably supported in both the vertical and horizontal directions at each end from threaded support rods affixed thereto. Nuts clamp the threaded support rods in corresponding vertically extending slots provided in a support member attached to the bow. Interaction between opposing supports facilitates, in a simple and convenient manner, the fine incremental adjustment capability required for the system to perform well. Alternative embodiments increase the isolation between adjustments and provide for vernier vertical adjustment.

10 Claims, 6 Drawing Figures

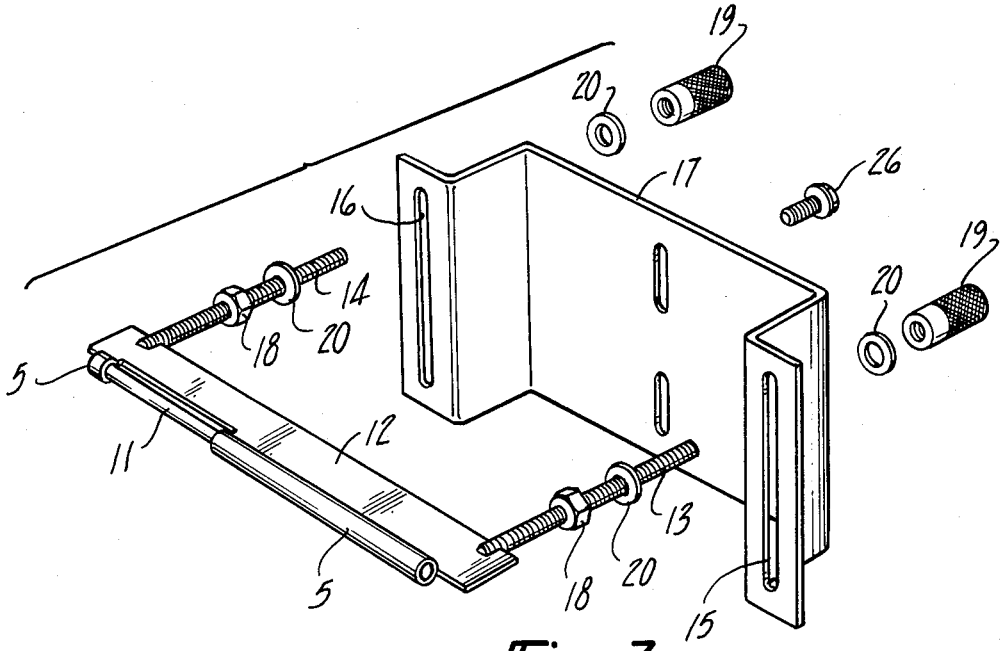
Fig-3
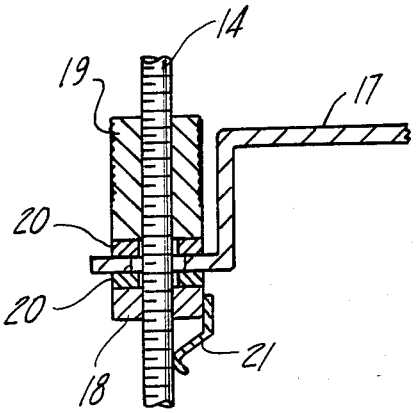
Fig-4
Fig-5
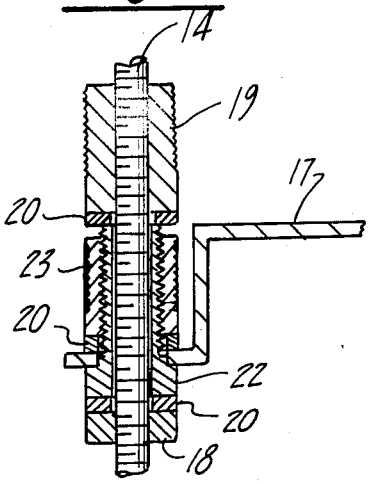
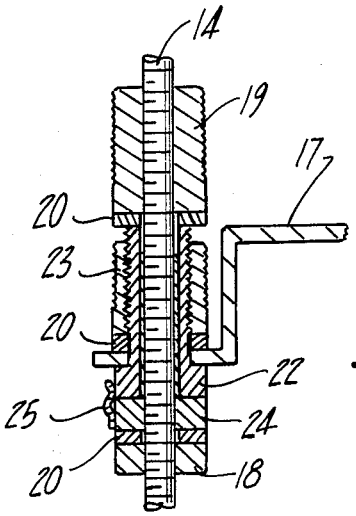
Fig-6

SIGHT SYSTEM FOR ARCHERY

BACKGROUND

1. Field of Invention

This invention concerns an improved sight system for archery based upon micro-sized, parallax-free sights and the optimum deployment and mounting of such rights.

2. Prior Art

Bead sights are widely employed in archery and their application has been substantially enhanced by the availability of mounting brackets that enable a plurality of bead sights to be disposed one above the other in semi-fixed multi-range sighting systems. Usually the position of each bead sight is preselectably adjustable in both the lateral and vertical directions. A variety of techniques are employed to provide for adjustment, with bead-carrying threaded rods clamped by finger nuts in one or more vertically extending slots in the mounting bracket being common.

The greatest limitation of such sights is that they are subject to parallax errors. Any drift in anchor point or head orientation results in the rearward end of the arrow being inadvertantly offset and the arrow not flying as aimed, even though the shooter percieves his aim to be true.

The telescopic sight represents a known means for implementing a parallax-free fiducial reference of aim. Bow mounts for single telescopic sights are disclosed in U.S. Pat. No. 3,266,149 by L. Y. Powell, in U.S. Pat. No. 3,302,292 by Aikin and in U.S. Pat. No. 4,291,469 by N. J. Weast. None of these offers the large range span, compact size, ability to accomodate bows of different velocities, cost effectiveness and indication of accuracy reducing bow hand torque as does the sight system of my invention.

A group of parallax-free sights working on a common principle, herein as a class termed restricted-field direct-view collimator sights, have been disclosed by G. C. Luebkeman et al. in U.S. Pat. No. 3,362,074, by W. E. Steck III in U.S. Pat. No. 3,700,339, by G. C. Luebkeman in U.S. Pat. No. 3,912,400 and by C. J. Ross in U.S. Pat. No. 3,949,482. While disclosed for many years, the restricted-field direct-view collimator sight has yet to find acceptance in archery. Briefly this sight can be thought of as only the occular portion of a telescopic sight, in which the fiducial reference is formed. The objective and inverting portions of the telescope are deleted and the lateral dimensions of the resulting sight are restricted so that the target can be viewed around rather than through the sight. Being parallax- free, this type of sight is of potential value in archery where range is limited by the weapon and magnification is more often a detriment than an asset, especially in hunting which is the primary force supporting commercial archery. My invention is based upon the belief that the factors preventing commercial acceptance of this type sight in archery are the lack of the proper sight system concept as well as lack of associated means for mounting such sights to the bow with the necessary adjustability, convenience, and ruggedness. The thrust of my invention is to provide such a system concept and such mounting means.

It is also known art to affix independantly adjustable front and rear sights to an archery bow on a cross member of extended length, see for example BOW AND ARROW, Febuary 1984, pg. 8. While directional in character, as are the refractive sights discussed above, the front-rear sight arrangement requires alignment of two references to the target rather than one, which is a much greater burden when aiming a bow held at full draw than when aiming a lightly triggered fire-arm. In addition such sights are bulky if provided with adaquate base length and interpolation between sights on intermediate range targets is far more difficult than for the sight system of my invention.

SUMMARY OF INVENTION

In broad terms the sight system of the invention is a multi-range archery sight comprising a vertical array of refractive sights, each generating a parallax-free fiducial reference of aim but otherwise subtending such a small lateral field of view that the target is seen primarily around rather than through the sight. Extremely small diameter, unity power telescopic or restricted-field direct-view collimator sights are examples of such refractive sights. The invention recognizes that the extended vertical field needed to accomodate the gravitational fall of the relatively slow arrow can be provided in this manner even though the fields of the refractive sights are extremely small. In turn making refractive sights of small transverse dimensions leads to several interlinked advantages in that (1) the cost of the individual sights is low because of relaxed optical requirements and the corresponding low cost of the small lenses, (2) a lateral shift of the position of the fiducial reference of aim in the field of the sight is induced by extraneous, accuracy-defeating torque communicated to the bow handle via the bow hand and a small field makes this shift readily percieved so that the fault can be corrected and (3) the minimum length of a refractive sight scales with its diameter so that small transverse dimensions translate to short sight length allowing the sight system to be compact and sturdy yet light.

Another facet of the invention resides in positioning and orienting the individual sights having but micro-sized fields to accomodate the physical characteristics, shooting style and manual dexterity limits of individual archers. To this end the invention provides preselectable adjustment of the vertical position (elevation) and lateral position (windage) of the overall field of each sight while concurrently providing preselectable centering of the fiducial reference in each field in both vertical and lateral directions.

Specific methods of implementing the invention are addressed under the detailed description section and the resulting sight system offers a combination of advantages not available in any other system including (1) improved accuracy through compensation of drift in anchor point, (2) improved accuracy through communication of the presence of extraneous bow hand torque via a highly visible dispacement of the fiducial reference from field center, (3) multi-range capability extending over an unlimited field, (4) high visibility over a wide range of ambient light levels, (5) compact size, (6) light weight, (7) sturdiness and (8) moderate cost of manufacture.

Accordingly an object of the invention is to provide an archery sight system of improved accuracy through automatic compensation for inadvertant drift in the point of anchor. Another object is to provide an archery sight system offering a plurality of semi-fixed, parallax-free fiducial references of aim that are preselectably and precisely adjustable to accomodate different ranges, different arrow velocities, and different operators with varying physical characteristics and shooting styles. Another object is to provide an archery sight system of improved accuracy by providing an indicator of torque applied to the bow handle via the bow hand. Still another object is to attain the above stated objects in a cost effective, compact, rugged, and mechanically stable manner. These and other objects and advantages of the sight system for archery of my invention will become more readily apparent from the following detailed disclosure of embodiments thereof along with the accompanying drawings.

BRIEF DESCRIPTION OF THE DRAWINGS

FIG. 3 is an exploded view of a portion of FIG. 1 showing a preferred embodiment for mounting individual sights in a preselectably adjustable manner in accord with the invention.

FIG. 4 is an exploded sectional view taken along 4—4 of FIG. 1 wherein an optional refinement, a drag member, is also shown.

FIG. 5 is an expanded sectional view of an alternate embodiment of the structure of FIG. 4 that completely isolates the vertical and lateral adjustments.

FIG. 6 is an expanded sectional view of an alternate embodiment of the structure of FIG. 5 that additionally provides vernier adjustment in the vertical direction.

DESCRIPTION OF THE PREFERRED EMBODIMENTS

Figure 1:
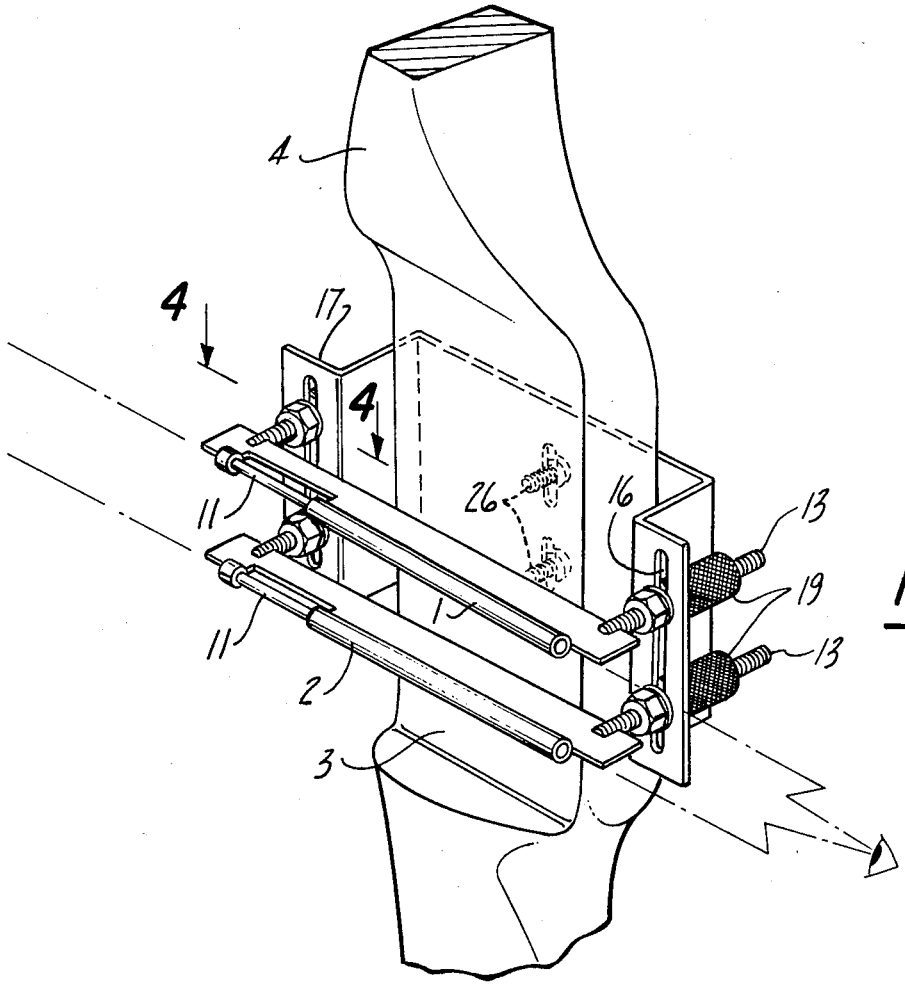
FIG. 1 is a perspective view of the sight system of the invention installed on an archery bow.

Referring to FIG. 1, refractive sights of restricted transverse dimensions 1 and 2 represent a plurality of such sights deployed in a vertical array in the sight window 3 of archery bow 4. Each of said sights, which can for example be telescopic or restricted-field direct-view collimator sights, displays a substantially parallax-free fiducial reference when viewed along or nearly along its optical axis. The maximum transverse dimensions of sights 1 and 2, excluding supports, are about the same as or smaller than the diameter of the shaft of a typical archery arrow (0.31 inch), the tip of which is an archery aim reference immemorial and not ordinarily thought to unduly obsure the target.

Figure 2:
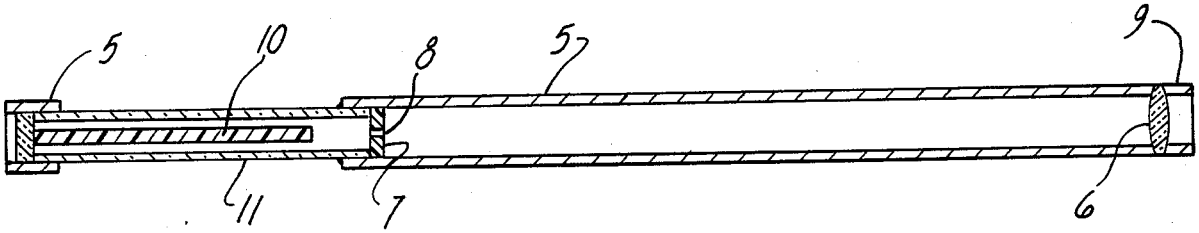
FIG. 2 is a sectional view illustrating a restricted-field direct-view collimator sight.

FIG. 2 illustrates an embodiment of sights 1 and 2 following the restricted-field direct-view collimator approach. Elongated housing 5 supports converging lens 6 at one end and reticle 7 bearing aperture 8 at the other. Hood 9 protects lens 6. Illuminator rod 10 is made from transparent material loaded with a fluorescent dye. Ambient light passes through transparent cover 11 into rod 10 where it is absorbed by the dye and re-emitted in spectrally concentrated form in all directions. Rod 10 captures and directs a portion of this re-emitted light through aperture 8. In accordance with well established optical principles a virtual image of illuminated aperture 8 is observed upon looking into lens 6. By appropriate selection of parameters the longitudinal position of this image can be placed a great distance beyond of lens 6 making the fiducial reference generated in this manner substantially parallax-free. The exit pupil is set by lens 6 which is constrained in size by the transverse dimensions of housing 4. For purposes of system understanding, lens 6 can be thought of as a window of view on the fiducial reference located therebehind at approximately target range.

The unity power telescopic sight is so analagous to the restricted-field direct-view collimator sight that a separate description is not needed. An advantage of the telescopic sight is that less of the target is obscured. Disadvantages include lower visibility of the fiducial reference and greater complexity and cost. However, the manufacture of a unity power telescopic sight of the diameter of an arrow or less and but a few inches long is much less costly than that of a conventional telescopic sight.

FIG. 3 illustrates a preferred embodiment of the invention for providing the required preselectable adjustments of sights 1 and 2 in a simple, compact, sturdy and precise manner. Elongated bridge member 12 is adjustably supported at each end from threaded support rods 13 and 14 affixed thereto. The threaded support rods 13 and 14 extend laterally in the same direction and are inserted in two corresponding parallel, vertically extending slots 15 and 16 provided in plate—like support member 17 affixed to bow 4 by, for example, screws 26 as shown in FIG. 1. Each threaded support rod 13 and 14 inserted in its corresponding slot 15 and 16 is clamped to plate-like support member 17 by a straddling pair of clamping nuts 18 and 19. Usually one nut, shown as 18, of pair 18 and 19 serves as a positioning nut while the other, shown as 19, serves as a clamping nut. Sight housing 5 is joined to elongated bridge member 12 by soldering, welding or the like with the optical axis of the sight alingned along the longitudinal axis of bridge member 12. As illustrated, the thin, elongated blade form of bridge member 12 joined to sight housing 5 along at least a portion of their common boundary is particularly stiff and strong yet effectively minimizes obscuration of the target scene. As an economy measure sight housing 5 can concurrently function as bridge member 12, but for a given level of target obscuration, strength and stiffness are sacrificed. Optional washers 20, placed as illustrated, enhance the stability of the sight system.

An important aspect of the embodiment arises from the interaction between the interconnected threaded support rods 13 and 14 located at opposite ends of bridge member 12, an interaotion that facilitates adequately fine adjustment of the lateral and vertical positions of each sight 1 and 2. In order for the compact, rugged and light weight character of the sight system to be fully realized, it is necessary that elongated bridge member 12 be no longer than about 4 inches. At the same time the angular precision with which the sight is adjusted should be on the order of 1 milliradian or about 1 inch at 30 yards. It follows that the relative positions of the threaed support rods 13 and 14 must be set within a few thousandths of an inch, roughly the thickness of a human hair and almost an order of magnitude more precisely than that required for the conventional archery bead sight. Fortunately the interaction between end adjustments makes accuracy of this required precision attainable. That is to say, if the pair of nuts 18 and 19 on threaded support rod 13 at one end are in the tightened state while the pair of clamping nuts 18 and 19 at the opposite end on threaded support rod 14 are loosened for adjustment, the vertical position of the loosened end is still preserved against low level perturbing forces, such as gravity and careful handling, by friction at the clamped end. In this manner lateral adjustment can be effected with minimal upset of the prior vertical adjustment. In a similar manner the unitary structure comprised of bridge member 12 and support rods 13 and 14 affixed at each end thereto prevents either support rod 13 or 14 from rotating so that tightening of clamping nut 19 cannot cause rotation of opposing positioning nut 18, thereby protecting the positioning function of nut 18 and facilitating fine, well controlled, lateral position adjustment.

In this embodiment the adjustments associated with rearward threaded rod 13 and rearward slot 15 establish the vertical and lateral positions of lens 6 and therefore the vertical and lateral positions of the field of view while the adjustments associated with forward threaded rod 14 and forward slot 16 establish the vertical and lateral positions of the fiducial reference within this field of view.

The above embodiment is simple, compact, cost effective and adaquately precise for most purposes. However, for situations where extreme precision of adjustment is required or where cost is a secondary consideration, the refined embodiments of FIG. 5 and FIG. 6 offer greater precision and require less dexterity to adjust. For comparison FIG. 4 is a sectional view of the embodiment of FIG. 1 already discussed with an optional addition of elastically loaded drag member 21 affixed to positioning nut 18 and pressing on rod 14, thereby supressing inadvertently induced rotation of positioning nut 18.

FIG. 5 illustrates an alternate embodiment of the adjustment means of FIG. 4. Hollow bolt 22 has a bore sized to slip over threaded support rod 14 (or rod 13). Hollow bolt 22 has a head larger than the width of slot 16 and accordingly can be clamped in preselectable vertical position in slot 16 by mating nut 23 threaded on hollow bolt 22. Keying hollow bolt 22 to slot 16 prevents rotation of hollow bolt 22 while tightening nut 23, facilitating this adjustment. Nuts 18 and 19 straddle hollow bolt 22 and lock threaded support rod 14 thereto upon tightening. This embodiment completely isolates vertical adjustment from horizontal adjustment even without careful handling. This embodiment can be introduced at either one or both rods 14 and 13.

FIG. 6 illustrates an alternate embodiment of the adjustment means of FIG. 5 incorprating vernier vertical adjustment. The bore of hollow bolt 22 recieves the cylidrical body section of headed cam 24. Cam 24 is eccentrically through-bored to accept corresponding threaded support rod 14 (or 13). The bore is placed about 0.015 inches off center so that rotating cam 23 from 45 degrees above to 45 degrees below its neutral, forwardly (or rearwardly) most extended position, translates threaded support rod 14 about 0.02 inches in the vertical direction. The head of cam 24, along with optional washer 20 if included, is sandwiched between the head of hollow bolt 22 and positioning nut 18. Headed cam 24 can only be adjusted when clamping nut 19 is in the loosened state. To prevent inadvertant rotation of cam 24 when adjusting positioning nut 18, a torque couple, represented as elastically loaded drag member 25 attached to headed cam 24 and frictionally contacting the head of hollow bolt 22, can be introduced.

A limitation of the embodiments of FIGS. 5 and 6 is that the outside diameter of hollow bolt 22 and mating nut 23 tend to become so large that adjoining sights 1 and 2 interfere at small range intervals. This limitation can be overcome by providing an offset plurality of slot pairs 15 and 16 in platelike support member 17 with adjacent sights staggered between offset slot pairs.

Since many changes and variations of the invention may be made without departing from the inventive concept, it is not intended to limit the invention otherwise than as required by the appended claims.

What is claimed is:

1. A sight system for an archery bow, the sight system having a vertical array of independantly adjustable sighting elements disposed in the sight window of the archery bow, wherein the improvement comprises:

at least one of the sighting elements being a refractive sight having a viewed end, the area within the outline of said viewed end being less than the end-on area of the shaft of a a typical archery arrow, said viewed end providing a window of view on a substantially parallax-free fiducial reference appearing to reside therein;

first adjustment means acting between the archery bow and said refractive sight for preselectably adjusting the position of said viewed end of said refractive sight in the sight window of the archery bow in the vertical direction;

second adjustment means acting between said archery bow and said refractive sight for preselectably adjusting the position of said viewed end of said refractive sight in the sight window of the archery bow in the lateral direction;

third adjustment means for preselectably adjusting the position of said parallax-free fiducial reference in the vertical direction in said window of view of said refractive sight; and fourth adjustment means fornpreselectably adjusting the position of said parallax-free fiducial reference in the lateral direction in said window of view of said refractive sight.

2. A sight system for an archery bow having a sight window comprising:

a plate-like support member attachable to the archery bow in the vicinity of the sight window, said plate-like support member having a forward slot provided therethrough, said forward slot extending generally in the vertical direction, said plate-like support member also having a rearward slot provided therethrough, said rearward slot being substantially parallel to said forward slot;

at least one elongated bridge member having a longitudinal axis, said elongated bridge member having a forward threaded support rod affixed to the forward end thereof and extending laterally therefrom, said at least one elongated bridge member having a rearward threaded support rod affixed to the rearward end thereof and extending laterally therefrom in the same direction as said forward threaded support rod, said forward threaded support rod being inserted and movably disposed in said forward slot in said plate-like support member and said rearward threaded support rod being inserted and movably disposed in said rearward slot in said plate-like support member;

a refractive sight having an optical axis and a viewed end, the area within the outline of said viewed end being less than the end-on area of the shaft of a typical archery arrow, said viewed end providing a window of view on a substantially parallax-free fiducial reference appearing to reside therein, said refractive sight being affixed to said at least one elongated bridge member with the optical axis of said sight being in substantial alignment with the longitudinal axis of said bridge member; and a pair of opposing clamping nuts threaded on each of said forward and said rearward threaded support rods, each pair of opposing clamping nuts straddling said plate-like support member and clamping said corresponding threaded support rods thereto.

3. The sight system of claim 2 wherein said refractive sight is a direct-view collimator sight.

4. The sight system of claim 2 further comprising:

at least one threaded bolt having a head and an axial through-bore recieving one of said threaded rods, said at least one threaded bolt being insertable in the corresponding slot of said plate-like support member; and a mating nut threadable on said at least one threaded bolt, straddling said plate-like support member between itself and said head of said at least one threaded bolt and in tightened state causing itself and said at least one threaded bolt to act as an integral portion of said plate-like support member.

5. The sight system of claim 4 wherein said at least one threaded bolt is keyed in said corresponding slot in said plate-like support member to prevent rotation about its longitudinal axis yet is free to translate within said corresponding slot while in the un-clamped state.

6. The sight sytem of Claim 4 further comprising a headed cam having a cylindrical body section recieved in the through-bore of said at least one threaded bolt, said cylindrical body section having an eccentrically located through-bore recieving said threaded support rod therethrough, the head of said headed cam being sandwiched between the head of said threaded bolt and one of said pair of opposing clamping nuts.

7. The sight system of claim 6 having an elastically-loaded force-coupling member acting between said one headed cam and said coressponding threaded bolt to supress inadvertantly induced rotation between them.

8. The sight system of claim 2 wherein at least one nut of one of said pairs of opposing clamping nuts has an elastically loaded drag member attached thereto, said drag member frictionally acting upon said corresponding threaded support rod thereby supressing inadvertantly induced rotation between said at least one nut in the loosened state and said threaded support rod.

9. The sight system of claim 2 wherein said refractive sight has a housing and said at least one elongated bridge member is a thin, horizontally oriented, elongated blade having a long edge, at least a portion of said long edge being joined with said housing thereby forming a combined structure of greater strength than said housing alone.

10. A sight system for an archery bow having a sight window comprising:

a plate-like support member attachable to the archery bow in the vicinity of the sight window, said plate-like support member having a forward slot provided therethrough, said forward slot extending generally in the vertical direction, said plate-like support member also having a rearaward slot provided therethrough, said rearward slot being substantially parallel to said forward slot;

a refractive sight having an optical axis, an elongated housing substantially parallel to said optical axis and a viewed end, the area within the outline of said viewed end being less than the end-on area of the shaft of a typical archery arrow, said viewed end providing a window of view on a substantially parallax-free fiducial reference appearing to reside therein;

said elongated housing having a forward threaded support rod affixed to the forward end thereof and extending laterally thereform, said elongated housing having a rearward threaded support rod affixed to the rearward end thereof and extending laterally therefrom in the same direction as said forward threaded support rod, said forward threaded support rod being inserted and movably disposed in said forward slot in said plate-like support member and said rearward threaded support rod being inserted and movably disposed in said rearward slot in said plate-like support member; and a pair of opposing clamping nuts threaded on each of said forward and said rearward threaded support rods, each pair of opposing clamping nuts straddling said plate-like support member and clamping said corresponding threaded support rods thereto.

* * * * *